United States Patent [19]

Stover

[11] Patent Number: 4,790,461

[45] Date of Patent: Dec. 13, 1988

[54] IMPLEMENT HOLDER

[76] Inventor: Ernest L. Stover, 1030 North St., Lockport, Ill. 60441

[21] Appl. No.: 140,563

[22] Filed: Jan. 4, 1988

[51] Int. Cl.[4] ..... A45F 5/00

[52] U.S. Cl. ..... 224/241; 224/234; 224/253; 224/904

[58] Field of Search ..... 224/253, 234, 235, 241, 224/904, 270; 211/70.6; 248/316.8

[56] References Cited

U.S. PATENT DOCUMENTS 3,450,317 6/1969 Ramer ..... 224/904 X 4,645,104 2/1987 Vokaty ..... 224/904 X

*Primary Examiner*—Renee S. Luebke

*Attorney, Agent, or Firm*—Augustus G. Douvas

[57] ABSTRACT

An implement holder for a claw hammer having an elongated handle and a claw and head member carried by and projecting generally from one end of the handle, comprising a waist belt, a support pad carried by the waist belt, and a cradle-like collar defining a tool storage opening for receiving the tool including a partial loop and a hinged gate. The hinged gate has two angularly-spaced elongated elements pivotally supported on the partial loop approximately at the junction of the two elements. The collar is fixed to and projects from the pad with the tool storage opening being accessible for storing a tool by a first pivoting movement of the gate in response to a gate opening force applied by the tool to one of the elements and with the tool being removed from the tool storage opening by a second pivoting movement of the gate which is a reversal of the first pivoting movement in response to a force applied by the tool to the second element.

13 Claims, 2 Drawing Sheets

IMPLEMENT HOLDER

BACKGROUND OF THE INVENTION

This invention relates to a tool holder which is particularly adapted for use as a waist-belt hammer holder.

The prior art is prolific in hammer holders which are supported by a user's waist belt. In general, these devices have a waist belt supporting a leather pad resting against the user's hip. A mechanical collar or loop is attached to the pad to provide a mechanism for storing a hammer. Various manual motions are used to holster and withdraw a hammer from a holder. Some prior art designs are shown in U.S. Pat. Nos. 2,618,419; 3,156,388; 3,599,847; 4,106,679: and 4,372,468: and U.S. Pat. Nos. D-258,550; D-261,197: and D-271,253.

None of these prior art hammer holders provide for a rapid storage and withdrawal of a hammer in and from a holder using a convenient, easy and natural manual motion to the rear of the wearer's body involving the same manual grip as is used in hammering. A hammer holder which can be accessed without altering one's manual grip on a hammer handle can improve both construction efficiency and safety.

Accordingly, a principal object of this invention is to provide a tool holder which improves construction efficiency and safety.

Another object is to provide a tool holder which can be readily accessed to both store and withdraw a tool in a natural and easy manual motion.

Another object is to provide a tool holder which can be readily accessed to both store and withdraw a tool without altering the user's manual grip on the tool handle from that employed in operating the tool.

Another object is to provide a tool holder that can be readily accessed to both store and withdraw a tool with a manual grip using a manual motion confined to the rearside of the wearer's body.

SUMMARY OF THE INVENTION

A preferred embodiment of the tool holder for attaining the objects of this invention features a waist-belt holder having a cradle-like collar defining a tool storage opening for receiving a tool, such as a hammer. The collar includes a partial wire loop cooperating with a novel hinged gate supported from a waist-belt pad. The hinged gate is located at the rear of the collar to pivot in a generally vertical attitude when the waist belt and the partial loop are disposed in generally horizontal but somewhat different attitudes.

The hinged gate is generally of a "boomerang" configuration having two angularly-spaced elongated elements pivotally supported relative the partial loop approximately at the junction of the two elements. The tool-storage opening defined by the collar is accessible to store a tool by a first pivoting movement produced by an opening force applied by the tool to one of the gate elements. A tool is removed from the tool storage opening by a second pivoting movement of the gate which is a reversal of the first pivoting movement in response to a force applied by the tool to the second element.

The particular disposition and mode of operation of the hinged "boomerang" gate results in the attainment of the highly desirable objects of the invention.

DETAILED DESCRIPTION OF THE DRAWINGS

In order that all of the structural features for attaining the objects of this invention may be readily understood, reference is made to the accompanying drawings wherein.

DETAILED DESCRIPTION OF THE PREFERRED EMBODIMENT

Figure 1:
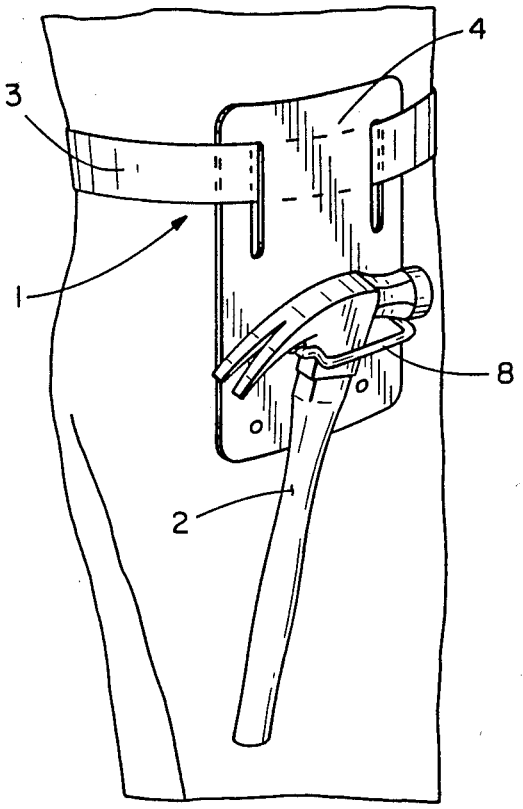
FIG. 1 is a view showing a preferred embodiment of the implement holder of this invention storing a conventional claw hammer.
Figure 2:
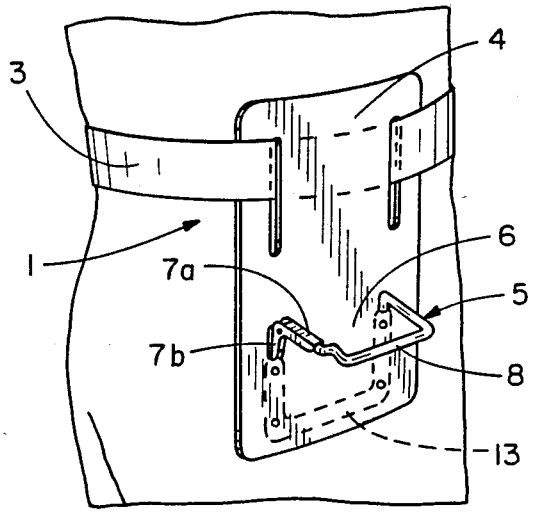
FIG. 2 is a view showing the holder cradle with its pivoting gate in the tool retaining position of FIG. 1.

Referring to the drawings, the structure and operation of the implement holder 1 of this invention is described as holding a conventional claw hammer 2. Other tools having a general configuration including an elongated handle supporting a projecting working member, such as a hatchet, for example, can also be holstered equally as well.

Figure 10:
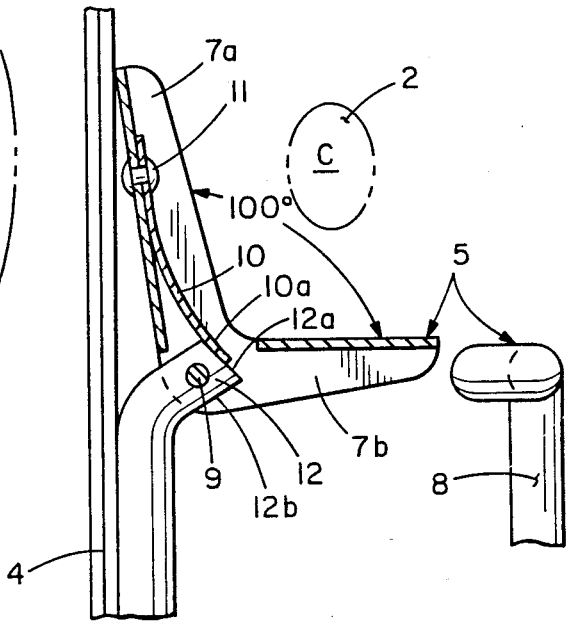
FIG. 10 is a side-elevation view related to FIG. 9 with the gate shown in section to disclose the leaf spring biased to hold the gate in the hammer release position (which is also the gate access position).

The principal elements of implement holder 1 comprise waist band 3 which carries slotted support pad 4, and cradle-like collar 5. Collar 5 defines a tool storage opening 6 for receiving a tool, such as hammer 2. Collar 5 is formed by a hinged gate 7, which has two angularly-spaced elongated elements *7a* and *7b*, pivotally supported on a partial formed-wire loop 8. Gate 7 is hinged on loop 8 at the junction of the two elements by pivot pin 9. The angle defined by the inner tool-actuated edges of gate elements *7a* and *7b* is optimally about 100° (FIG. 10). Any lesser angle might possibly result in interference between the gate and the tool handle.

Figure 6:
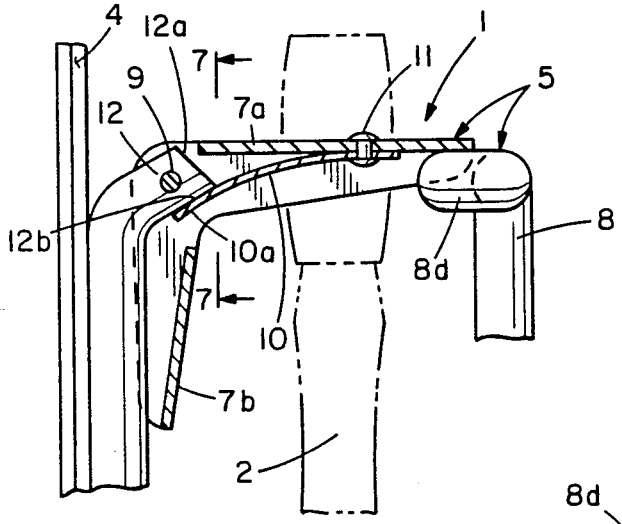
FIG. 6 is a partial side-elevation view (related to FIG. 4) which shows the gate in section to reveal the leaf biasing spring of the gate positioned in the tool retaining position.
Figure 7:
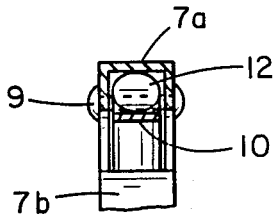
FIG. 7 is a section view taken along line 7—7 of FIG. 6 which shows the engagement of the leaf biasing spring with a cam section formed in the wire portion of the cradle adjacent the gate pivot pin.
Figure 8:
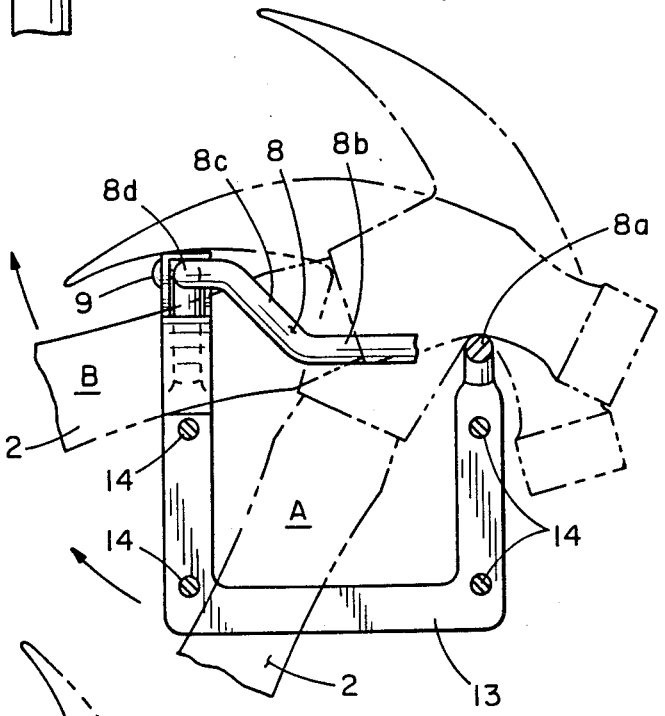
FIG. 8 is a sequence view which shows a claw hammer in broken line in the hammer hold position A within the holder cradle and in hammer release position B in response to the manual elevation of the hammer handle in a clockwise direction.
Figure 9:
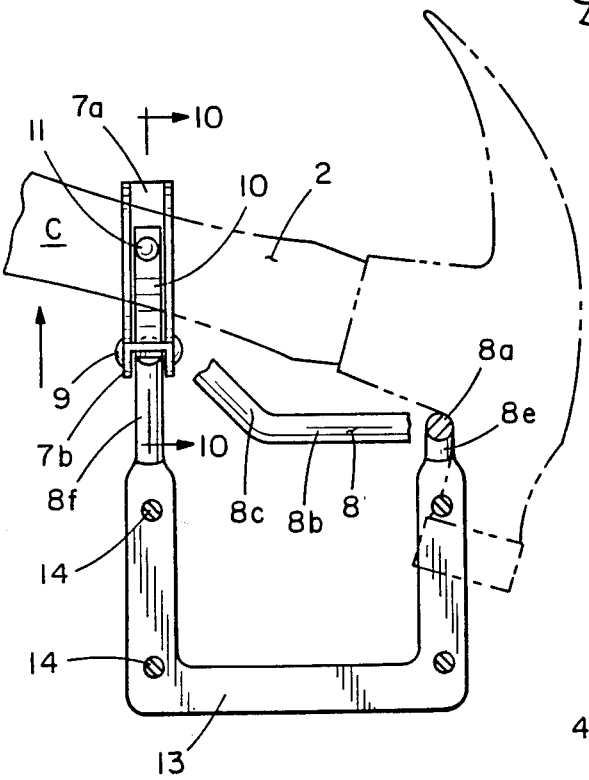
FIG. 9 is a further sequence view related to FIG. 8 in which the hammer handle has been elevated to actuate the gate to its tool release position.

Gate 7 is a snap-action biased into each of two operating positions by flat spring 10 which is fixed to gate element *7a* by rivet 11. FIGS. 1 through 8 represent the first gate 7 position in which a tool is holstered: and FIGS. 9 and 10 represent the second gate position which permits removal of the holstered tool. The cantilevered end 10*a* of spring 10 is cammed by wire cam 12 which presents cam surfaces 12*a* and 12*b* to contacting spring end 10*a* (FIGS. 6 and 10). Spring end 10*a* contacts cam surface 12*b* (FIG. 6) when hammer 2 is holstered; and spring end 10*a* contacts cam surface 12*a* (FIG. 10) when hammer 2 is removed from holder 1.

Partial loop 8 is formed from a rigid metal wire having a circular cross section. Wire cam 12 is similarly formed. Partial loop 8 and wire cam 12 both project from and are supported by an integral, flat, generally U-shaped, bracket 13 which is fixed to support pad 4 by a set of rivets 14. Bracket 13 is sandwiched between pad laminations 4*a* and 4*b* (FIG. 4) so that the bracket cannot be seen.

Figure 3:
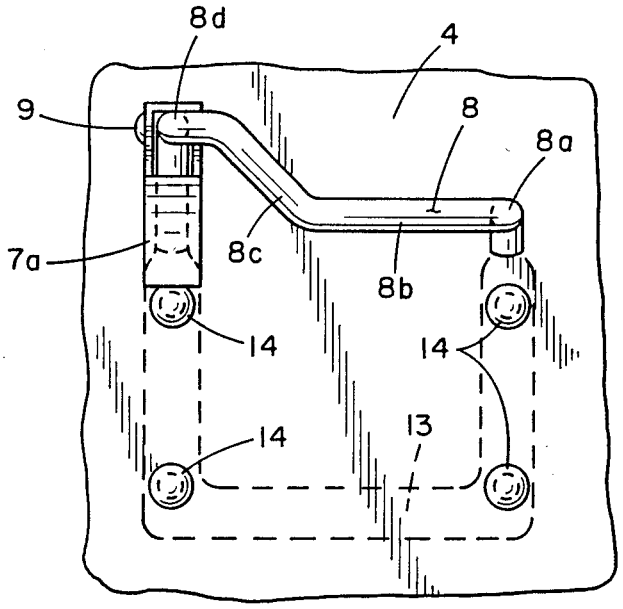
FIG. 3 is an enlarged side-elevation view of the holder cradle with the gate in the tool retaining position of Fig. 2.
Figure 4:
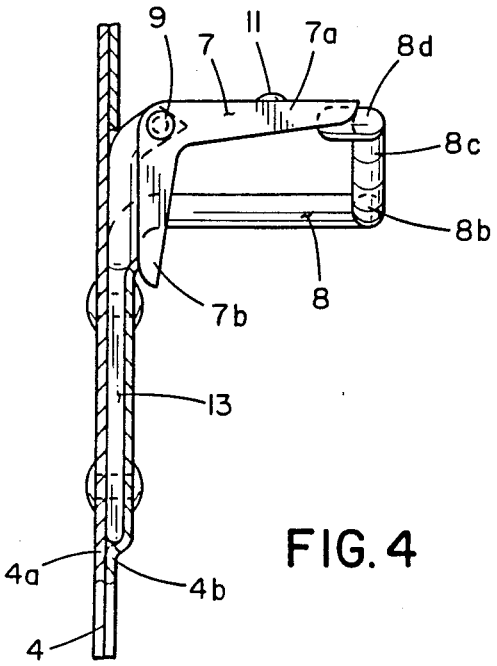
FIG. 4 is an end-elevation view (of the structure of Fig. 3) which shows the generally right-angle disposition of the gate actuating elements which form the cradle gate.
Figure 5:
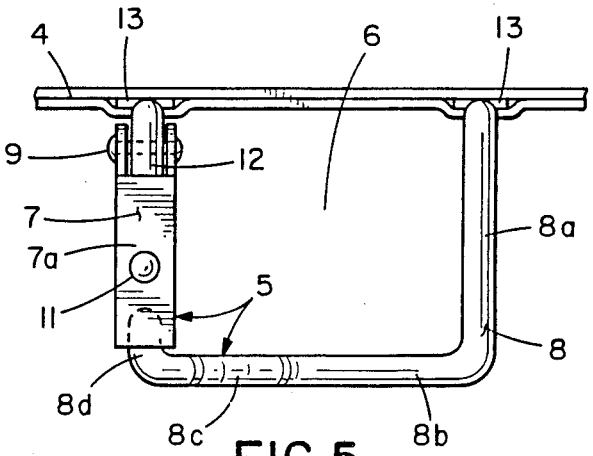
FIG. 5 is a plan view (of the structure of FIG. 4) which shows details of the hinged attachment of the gate to the bent-wire portion of the cradle.

Wire loop 8 is contoured to have several distinct collar-forming sections 8*a*, 8*b*, 8*c* and 8*d*. The relative disposition of front loop section 8*a* and rear loop section 8*d* is critical to the optimum tool storage functioning of holder 1. In particular, front loop section 8*a* should be disposed at a lower elevation than rear loop section 8*d* (which is at the same approximate elevation as gate element 7*a*) for the proper holstering of a conventional claw hammer. As is set forth in a subsequent portion of this specification, proper manipulation of a tool both for storage and removal from holder 1, requires that the lower portion of the tool handle be inclined to the rear of the upper handle portion connected to the tool head (see FIG. 1). This inclined disposition from the vertical enables the user to easily grasp the handle for both removal from and access to holder 1. Accordingly, loop section 8*c* is inclined to the rear to elevate rear loop section 8*d* above front loop section 8*a* (FIG. 3). In an alternative embodiment, loop sections 8*b* and 8*c* are formed as a single straight section. In the embodiment shown in the drawings, the bend in the composite length formed by sections 8*b* and 8*c* is cosmetic. Partial loop 8 is joined to U-shaped bracket 13, by circular loop support sections 8*e* and 8*f* (FIG. 9). Loop-support sections 8*e* and 8*f* are generally vertically disposed.

Gate 7 is of a general "boomerang" configuration with gate elements 7*a* and 7*b* formed with U-shaped channel configurations to strengthen the channel and balance the gate about pivot pin 9. Gate element 7*a* is longer than gate element 7*b* so that element 7*a* rests upon loop section 8*d* in the tool storage position (FIGS. 4 and 6) and gate element 7*b* clears loop section 8*d* when the tool is removed (FIG. 10). The pivoting of gate 7 in a generally vertical plane approximately normal to both the face of pad 4 and also approximately normal to the plane of storage opening 6 is important to the operation of holder 1.

The detailed sequence of operations in removing hammer 2 stored within holder 1 (as shown in FIG. 1) is as follows:

The lower end of the hammer handle is manually grasped with the same grip as is employed in using the hammer. The hammer is then pivoted from position A to position B (FIG. 8) with the hammer head preferably resting on front loop section 8*a*. As position B is reached, the lower edge of gate element 7*a* is contacted by the adjacent edge of the hammer handle. Further elevation of the handle to position C (FIGS. 9 and 10), snaps gate 7 from the hammer storage position of FIG. 6 to the hammer release position of FIGS. 9 and 10.

It should be noted that the manual grip that withdraws the hammer from the holder is the same grip used in hammering a nail, thus, greatly facilitating a carpenter's work.

The detailed sequence of operations in returning hammer 2 for storage within holder 1 is as follows:

After hammer 2 is removed from holder 1, gate 7 is biased by leaf spring 10 to remain indefinitely in the position shown in FIGS. 9 and 10. Hammer 2 is returned to holder 1 for storage without altering the manual grip used in hammering. The handle of hammer 2 is placed on gate element 7*b* (FIG. 10), and when the weight of the hammer overcomes the restraining force of bias spring 10, the gate snaps to the hammer storage position of FIG. 6. Thereafter, the user can release his manual grip as hammer 2 is trapped within collar 5 to assume the position of FIG. 1.

It should be understood that the above described structure is merely illustrative of the principles of this invention. Modifications can be made without departing from the scope of the invention.

What is claimed is:

1. An implement holder for a tool having an elongated handle and a working member carried by and projecting generally from one end of the handle, comprising a waist belt, a support pad carried by the waist belt, and a cradle-like collar defining a tool storage opening for receiving the tool including a partial loop and a hinged gate having two angularly-spaced elongated elements joined together at a junction, the gate being pivotally supported relative the partial loop approximately at the junction of the two elements, with the collar being fixed to and projecting from the pad, with the tool storage opening being accessible for storing a tool by a first pivoting movement of the gate in response to a gate opening force applied by the tool to one of the elements, and with the tool being removed from the tool storage opening by a second pivoting movement of the gate which is a reversal of the first pivoting movement is response to a force applied by the tool to the second element.

2. The combination of claim 1 in which the two gate elements are angularly spaced at approximately 100°.

3. The combination of claim I in which the gate pivots in a generally vertical attitude when the waist belt is disposed in a generally horizontal attitude.

4. The combination of claim 1 in which the gate has a generally boomerang configuration.

5. The combination of claim 1 including snap-action, biasing-spring means to hold the gate alternatively in a tool holding position or a tool release position.

6. An implement holder for a tool having an elongated handle and a working member carried by and projecting generally from one end of the handle, comprising support means to be applied to a wearer, and a cradle-like collar defining a tool storage opening for receiving the tool including a partial loop and a hinged gate having two angularly-spaced elongated elements joined together at a junction and pivotally supported relative the partial loop approximately at the junction of the two elements, with the collar being fixed to and projecting from the support means, with the tool storage opening being accessible for storing a tool by a first pivoting movement of the gate in response to a gate opening force applied by the tool to one of the elements, and with the tool being removed from the tool storage opening by a second pivoting movement of the gate which is a reversal of the first pivoting movement in response to a force applied by the tool to the second element.

7. The combination of claim 6 in which the hinged gate pivots in a generally vertical attitude when the tool storage opening is disposed in a generally horizontal attitude.

8. The combination of claim 6 in which the collar has both rear and front portions, and in which the hinged gate is located in the rear portion of the collar and also to the rear of any wearer of the support means.

9. The combination of claim 8 in which the gate pivots in a plane generally normal to an adjacent surface of the support means.

10. The combination of claim 8 in which the collar is inclined relative the support means so that the collar is inclined downwardly towards the front of the wearer, with the gate hinged on a rear collar pivot point located above the front portion of the collar.

11. An implement holder for a tool having an elongated handle and a working member carried by and projecting generally from one end of the handle, comprising support means to be applied to a wearer, a cradle-like collar having both rear and front portions defining a tool storage opening for receiving the tool including a partial loop and a hinged gate pivotally supported at the rear portion of the collar in a generally vertical plane when the wearer is erect, with the collar being fixed to and projecting from the support means and with the collar being inclined downwardly toward the front of the wearer with the tool storage opening being accessible for storing a tool by a first pivoting movement of the gate in response to a gate opening force applied by the tool, and with the tool being removed from the tool storage opening by a second pivoting movement of the gate which is a reversal of the first pivoting movement in response to a force applied by the tool.

12. The combination of claim 11 in which the hinged gate is of a general boomerang configuration.

13. The combination of claim 11 in which the hinged gate has two angularly spaced elongated elements joined together at a junction and pivotally supported relative the collar approximately at the junction of the two elements.

* * * * *